United States Patent [19]

Large

[11] 4,344,196

[45] * Aug. 17, 1982

[54] FITTED TOP CONTOUR SHEET

[76] Inventor: Helen F. Large, 25 A Center St., Rumson, N.J. 07760

[ * ] Notice: The portion of the term of this patent subsequent to Jan. 20, 1998, has been disclaimed.

[21] Appl. No.: 190,961

[22] Filed: Sep. 26, 1980

Related U.S. Application Data

[63] Continuation-in-part of Ser. No. 94,326, Nov. 14, 1979, Pat. No. 4,245,365.

[51] Int. Cl.[3] ..... A47G 9/02; A47G 9/04

[52] U.S. Cl. ..... 5/496; 5/460

[58] Field of Search ..... 5/496, 497, 498, 485, 5/482, 495, 460

[56] References Cited

U.S. PATENT DOCUMENTS

| | | | |
|---|---|---|---|
| 3,179,958 | 4/1965 | Carris | 5/496 |
| 3,832,743 | 9/1974 | Smith | 5/496 |
| 4,035,854 | 7/1977 | Pardee | 5/497 |
| 4,245,365 | 1/1981 | Large | 5/496 |

FOREIGN PATENT DOCUMENTS

| | | | |
|---|---|---|---|
| 73842 | 9/1960 | France | 5/498 |

*Primary Examiner*—Alexander Grosz

*Attorney, Agent, or Firm*—LeBlanc, Nolan, Shur & Nies

[57] ABSTRACT

A fitted top contour sheet having an end pocket receiving the rear of a mattress and fasteners to secure the bottom of the pocket to the mattress or the sides of the pocket to an underlying bottom sheet.

7 Claims, 9 Drawing Figures

FITTED TOP CONTOUR SHEET

CROSS REFERENCE TO RELATED APPLICATION

This is a continuation-in-part of Ser. No. 94,326, filed Nov. 14, 1979 now U.S. Pat. No. 4,245,365.

BACKGROUND OF THE INVENTION

This invention relates generally to bedclothing and more specifically to a fitted top contour sheet of uncomplicated structure which is easily attached to and detached from the mattress or underlying bottom sheet with which it is used.

The prior patented art is replete with examples of contour, fitted bedclothing including bottom sheets, top sheets, and blankets. Additionally, various means for attaching top sheets and blankets to the underlying mattress or bed are also disclosed in the prior patented art. For example, U.S. Pat. No. 2,757,389 issued to A. J. King discloses a fitted top contour sheet including an arcuate edged panel so that when the sheet is fitted onto a mattress, a foot pocket or space 32 is provided. Other examples of pocketed, fitted top sheets are illustrated in U.S. Pat. Nos. 2,151,375 issued to A. R. DeVoe and 3,654,646 issued to S. J. McMahon, Jr. A water bed including a mattress pad, bottom sheet and top sheet, all attached together by means of hook and loop type fasteners, such as those sold under the trademark "Velcro" is disclosed in U.S. Pat. No. 4,040,133 issued to M. B. Gilreath. Other disclosures to hook and loop type fasteners for securing bedclothing to the bed are found in U.S. Pat. Nos. 3,066,321 and 3,066,323, both issued to M. M. Kintner. A hook and eye attachment for bedclothing to bed is shown in U.S. Pat. No. 3,011,182 issued to A. R. Burks while U.S. Pat. No. 3,179,958 discloses the use of buttons and cooperating buttonholes for securing the bedclothing. In U.S. Pat. No. 2,683,267 issued to C. Weil, a pair of ties are employed to secure a top blanket to the bedposts of a bed.

However, the prior art does not disclose a fitted top contour sheet readily formed from a single, rectangular sheet including a pocket structure adapted to fit beneath the foot of a bed mattress to thus provide a comfortable top sheet not requiring additional structure to provide foot space (such as disclosed at 32 in the King patent hereinbefore discussed). Nor is such a sheet disclosed including an uncomplicated fastening attachment for securing the sheet to the underlying mattress or bottom sheet.

SUMMARY OF THE INVENTION

Accordingly, it is a principal object of the invention to provide a fitted top contour sheet of uncomplicated structure, readily made from a single, rectangular sheet, which includes a pocket to fit the sheet to an underlying mattress and is so formed to provide ample foot space for the user.

It is another object of the invention to provide a fitted top contour sheet having a rear pocket to fit the sheet to an underlying mattress, and including easily attached and detached fastening assemblies between mattress and sheet pocket or a bottom sheet and the top sheet pocket so that the sheet may be easily removed for laundering, and the attaching assembly will not harm or tear other clothing, etc. that may be laundered with the sheet.

As disclosed herein, the fitted top contour sheet of the invention includes a top panel having length and width dimensions which are the same as the underlying mattress, side panels depending from the top panel, and a pocket formed at the rear of the sheet and arranged to engage the foot and part of the bottom of the underlying mattress. The pocket includes a rear, vertical panel, a horizontal bottom panel and side gusset members joining together adjacent side edges of the vertical and bottom panel. When the sheet is placed on the mattress, an angled opening from each side panel to the upper rear corner of the foot of the mattress provides sufficient "give" in the top panel so that a comfortable foot space is provided beneath the rear of the top panel for the user. A pair of hook and eye assemblies secure the bottom panel of the pocket to the mattress and are easily separated so that the sheet may be laundered. Alternatively, a pair of fasteners secure sides of the pocket to an underlying bottom sheet on the mattress. Each fastener may be a dowel on the bottom sheet through a slit informed in the pocket side, an otherwise conventional snap fastener, or a hook and eye assembly.

BRIEF DESCRIPTION OF THE DRAWINGS

Further objects and advantages of the present invention will become readily apparent by reference to the following specification and drawings in which.

FIGS. *6a* to *6d* are partial section views taken along lines 6—6 of FIG. 5, drawn to an enlarged scale and showing alternative fasteners for attaching the fitted top contour sheet to a bottom sheet.

DESCRIPTION OF THE PREFERRED EMBODIMENTS

Figure 1:
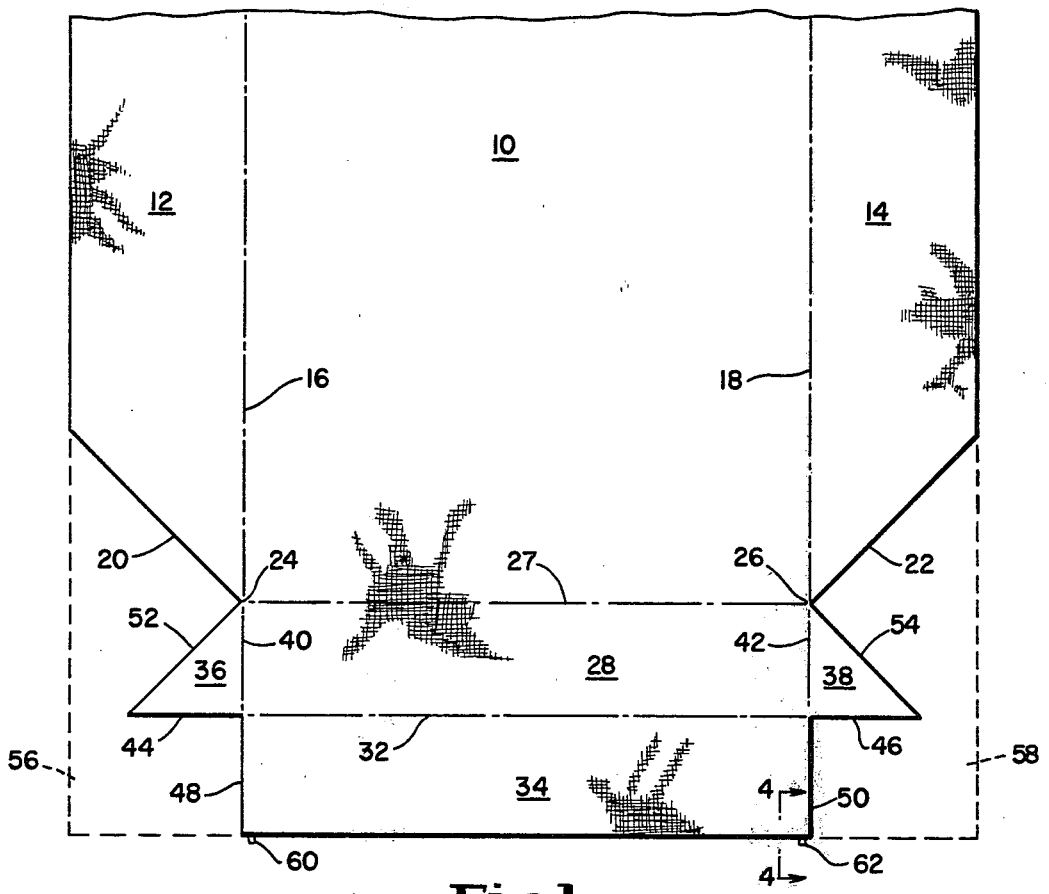
FIG. 1 is a top, partial plan view illustrating manufacture of a fitted top contour sheet in accordance with the principles of this invention.
Figure 2:
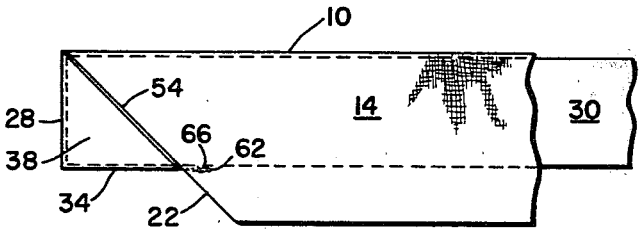
FIG. 2 is a partial, elevation view of the top sheet of FIG. 1 in place on a mattress.

Referring now to the drawings by reference character, FIGS. 1–4 disclose an embodiment of the invention wherein the fitted top contour sheet is attached to a mattress. FIG. 1 discloses the outline of a fitted top contour sheet made from a single piece of rectangular sheet material in accordance with the teachings of this invention. A central, top panel 10 is segregated from depending side panels 12 and 14 by fold lines 16 and 18. Each side panel 12, 14 has rear edges 20, 22, respectively, formed at an angle of about 45°, outwardly and forwardly from rear corners 24 and 26 to top panel 10. Another fold line 27 divides top panel 10 from a rear vertical panel 28 having a width dimension approximately the same as that of top panel 10 and a heighth about the same as the thickness of an underlying mattress 30 (FIG. 2). Another lateral fold line 32 divides vertical panel 28 from a horizontal, bottom panel 34 which lies beneath the foot of mattress 30 when the completed sheet is placed on mattress 30.

When initially cut as shown in FIG. 1, vertical panel 28 has a trapezoidal configuration. Each end of panel 28 is further divided from a pair of gusset members 36 and 38 by vertical fold lines 40 and 42, respectively. Then, a base edge 44 and 46 of each gusset 36, 38 is sewn to its adjacent side edge 48, 50, respectively, of horizontal bottom panel 34 to thus form a pocket which engages the foot and a part of the bottom of mattress 30, as is clearly illustrated in FIG. 2. When the completed sheet is in place on mattress 30, open, angled edges 52, 54 of each respective gusset member 36, 38 lie essentially parallel to and adjacent edges 20, 22 of side panels 12, 14, respectively. Thus an opening is provided up to the upper rear corners of mattress 30 so that a user may place his feet comfortably beneath panel 10; there is sufficient give in the structure because side panels 12, 14 are not secured to the mattress. In usual practice, of course, they will not be tucked beneath mattress 30 when the bed is made. However, these cut openings just described eliminate the bulk of excess folds of sheeting having to be tucked in together with an overlying blanket (not shown), as when employing the "nurse's corner" style of making a bed.

After cutting of the material into the sheet illustrated in FIG. 1, portions 56, 58 may be discarded as surplusage.

A pair of hook members 60, 62 are sewn (as shown at 64, FIG. 4) or otherwise attached to the free corners of bottom panel 34. Mating eyes are secured to the bottom edges of mattress 30 one of which is illustrated at 66, FIG. 3, so that the sheet may be conveniently secured to mattress 30. Preferably, each eye 66 is made of simple fabric tape. Unlike prior art constructions, the hook eye assemblies are secured beneath the mattress so that they do not discomfort the user when the bed is slept on. As shown, the hook and eye assemblies are secured at edges of mattress 30 so they may be readily detached when the sheet requires laundering. Additionally, it has been found that provision of only 2 small hooks 60, 62 allows the sheet to be laundered with other clothing without causing any damage to such other clothing.

Figure 3:
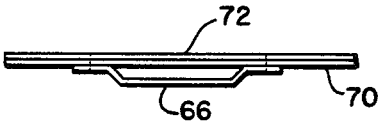
FIG. 3 is an elevation view of an eye member which may be attached to a mattress.
Figure 4:
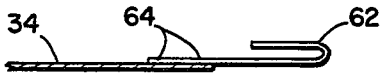
FIG. 4 is a view taken along lines 4—4 of FIG. 1, drawn to an enlarged scale and disclosing a hook employed with the eye of FIG. 3 to secure the sheet to a mattress.

FIG. 3 illustrates one embodiment of eye 66, the ends of which are attached by a suitable adhesive to a backing strip 70 of cardboard or plastic which may have a layer 72 of pressure sensitive adhesive on the rear thereof. A purchaser of a sheet made in accordance with this invention may simply remove an otherwise conventional backing strip (not shown) from layer 72 and then hand press each eye on to the lower edges of the mattress 30, after fitting the sheet onto the mattress to determine the correct location for each eye. The hooks and eyes may be secured where illustrated or, if desired, somewhat inwardly of the free corners of bottom panel 34 and, consequently, inwardly of the side edges of mattress 30, therebeneath (not shown). Pairs of eyes 66 may be secured to both sides of mattress 30 so that the sheet may be used as disclosed when the mattress 30 is reversed or turned over for even wear. Since each eye 66 is made of fabric tape, the user is not discomforted by the presence of the eyes 66 on top of the mattress. In retailing the invention, the manufacturer may include this extra pair of eyes for convenience of the consumer.

Figure 5:
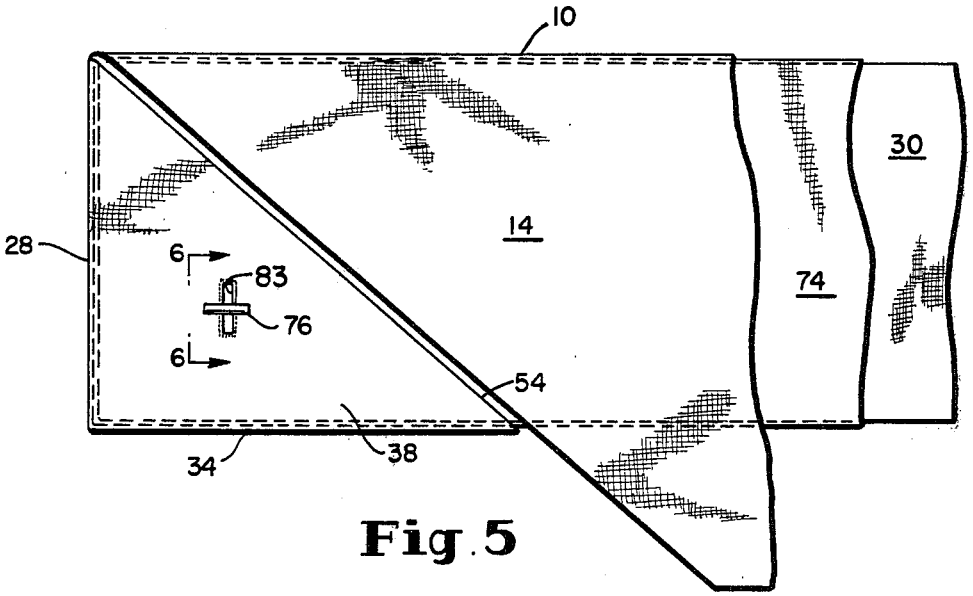
FIG. 5 is a partial, elevation view similar to FIG. 2 but drawn to an enlarged scale and showing attachment of a fitted top contour sheet to a bottom sheet.
Figure 6A:
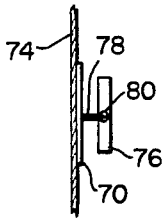
Figure 6B:
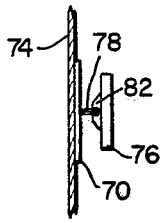
Figure 6C:
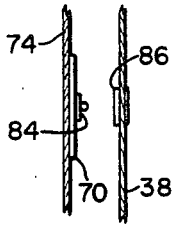
Figure 6D:
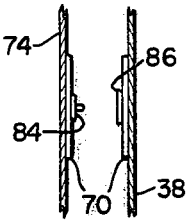
Figure 7:
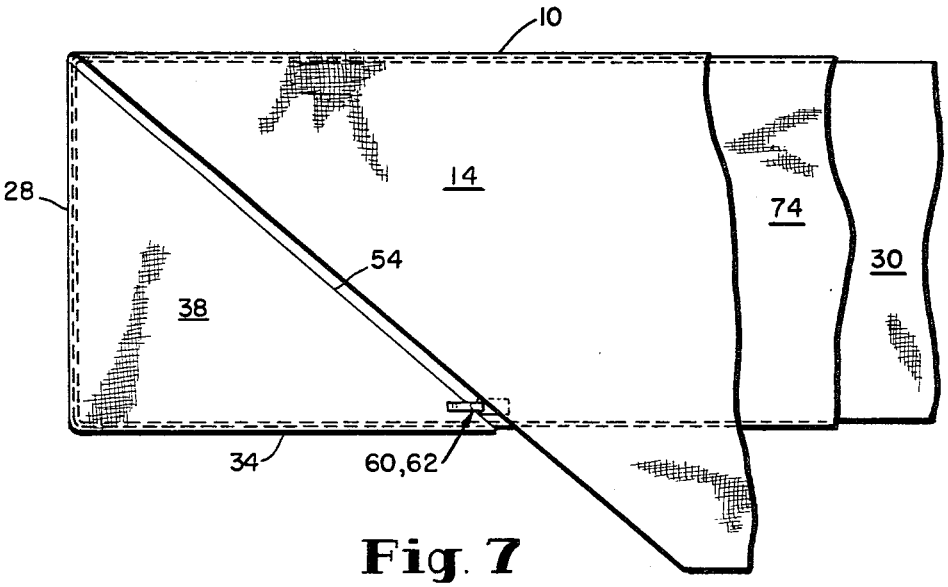
FIG. 7 is a view similar to FIG. 5 but showing a hook and eye fastener for attaching the fitted, top contour sheet to a bottom sheet.

Turning now to FIGS. 5–7, further embodiments of the invention will be discussed. The top contour sheet is the same as that discussed above and shown in FIGS. 1–4. However, alternative fastening means for the top sheet are disclosed. Furthermore, in each of these embodiments, the underlying mattress 30 may be provided with a bottom sheet 74, as is the usual and customary practice, which may be a contour sheet as is well known. Fasteners are provided to attach gusset members 36, 38 to the bottom sheet or cover 74, instead of attaching bottom panel 34 to mattress 30 as disclosed in FIGS. 1–4.

As shown in FIGS. 5 and **6*a*, 6*b*, one form of such a fastener could be a dowel 76, sewn at 78 to a backing strip 70 having an adhesive layer thereon, as previously discussed regarding the FIGS. 1–4 embodiments. A hole 80 (FIG. 6*a*) may be drilled through dowel 76 or a handle 82 (FIG. 6*b*) may be formed on dowel 76 to provide an anchorage for sewing dowel 76 to backing strip 70. A cooperating slit 83 is formed through each gusset member 36, 38 whereupon, after the top contour sheet is placed as shown in FIG. 5, each dowel 76 is inserted through slit 83 and then rotated 90° to secure gusset 38** and thus the top contour sheet in place.

Further alternative fastening assemblies are disclosed in FIGS. **6*c* and 6*d*. In place of the dowel and slit assembly, a simple snap fastener may be used, including a male member 84 and a mating female member 86. An adhesive layered backing strip 70 may be provided for easy attachment of the snap fastener members to the respective sheets, as shown in FIG. 6*d*, or, if desired, one member (e.g., male member 84) may be sewn to the gusset member while the other member is provided with an adhesive layered backing strip 70 so the consumer may attach the member to a bottom sheet 74** already on hand. Alternatively, the invention could be marketed as a top contour sheet and matching bottom contour sheet set, with both snap fastener members sewn in place during manufacture.

FIG. 7 illustrates still another alternative fastening assembly. In this instance, the hook and eye assemblies 60, 62 discussed above in the FIGS. 1–4 embodiments, may be installed at a lower, forward angle corner of each gusset member and the adjacent portion of the underlying bottom contour sheet 74.

The disclosed invention thus provides a neat, quickly arranged top sheet having maximum foot room, which is more easily handled, washed and dried, and folded for storage and is light and more easily placed on a bed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A fitted contour top sheet for use on a mattress comprising: a top panel having a front, a rear, and length and width dimensions approximately the same as the mattress with which the sheet is used, said top panel having opposed, rear corners; side panels along opposed sides of said top panel and terminating at the respective said corners, each said side panel having rear edges angled at about 45° from said rear corner, forwardly to an outboard edge of said side panel; a pocket formed at the rear of said top panel comprising a vertical panel joined to said top panel, interconnecting said top panel rear corners, and having a height approximately the same as the thickness of the mattress with which the sheet is used, said vertical panel having a width generally equal the width of said top panel, a horizontal bottom panel having a width dimension generally the same as that of said vertical panel and having a rear elongate edge joined to said vertical panel at a lower, rear edge thereof, a pair of side, generally triangular gusset members joined to adjacent side edges of said vertical and horizontal bottom members to thereby form a pocket which is fitted over the foot and a part of the bottom of the mattress with which the sheet is used; and means on said pair of gusset members cooperating with means attachable to the mattress for releasably attaching said top sheet to the mattress.

2. The fitted contour top sheet as claimed in claim 1 wherein said top panel, side panels, vertical panel and horizontal bottom panel are formed from a single sheet, said vertical member and gusset members forming a trapezoidal shaped panel in manufacture of said sheet prior to forming said pocket, the linear bases of said gussets being sewn to side edges of said bottom panel to thereby form said pocket.

3. The fitted top contour sheet as claimed in claim 1 wherein the mattress further includes a bottom sheet or or the like thereon, said cooperating means being located on said pair of gusset members and said means attachable to the mattress being mounted on the bottom sheet of the mattress adjacent said gusset members.

4. The fitted top contour sheet as claimed in claim 3 wherein said cooperating means comprise means defining a pair of elongate slits, one in each gusset member and said means attachable to the mattress comprising a pair of dowels attached to the mattress bottom sheet in the vicinity of said slits and being insertable therethrough and rotated with respect thereto to thereby secure said gusset members to the mattress.

5. The fitted top contour sheet as claimed in claim 3 wherein said cooperating means and said means attachable to the mattress comprise a pair of mating snap fasteners, one component of the snap fasteners being mounted on a side of said gusset member facing the mattress bottom sheet, the other component of the snap fastener being mounted on the mattress bottom sheet adjacent said one component.

6. The fitted top contour sheet as claimed in claim 5 wherein at least one of said snap fastener components further comprises a backing strip having a pressure sensitive adhesive surface for attaching the component to one of said gusset members or the mattress bottom sheet.

7. The fitted top contour sheet as claimed in claim 3 wherein said cooperating means and said means attachable to the mattress comprise a pair of hook and eye fasteners interconnecting said gusset members and the mattress bottom sheet.

* * * * *